US005751263A

United States Patent [19]

Huang et al.

[11] Patent Number: 5,751,263

[45] Date of Patent: May 12, 1998

[54] DRIVE DEVICE AND METHOD FOR SCANNING A MONOLITHIC INTEGRATED LED ARRAY

[75] Inventors: Rong-Ting Huang, Gilbert; Phil Wright, Scottsdale; Eric D. Joseph, Chandler, all of Ariz.

[73] Assignee: Motorola, Inc., Schaumburg, Ill.

[21] Appl. No.: 652,075

[22] Filed: May 23, 1996

[51] Int. Cl.[6] ..... G09G 3/32

[52] U.S. Cl. ..... 345/82; 340/825.82

[58] Field of Search ..... 345/82, 83, 76, 345/204–205; 340/825.82

[56] References Cited

U.S. PATENT DOCUMENTS

| | | | |
|---|---|---|---|
| 4,141,000 | 2/1979 | Thomas et al. | 345/82 |
| 4,701,754 | 10/1987 | Provonchee | 345/82 |
| 4,975,691 | 12/1990 | Lee | 345/209 |
| 5,426,446 | 6/1995 | Takei et al. | 345/204 |
| 5,583,349 | 12/1996 | Norma et al. | 257/88 |

*Primary Examiner*—Richard Hjerpe
*Assistant Examiner*—Vui T. Tran
*Attorney, Agent, or Firm*—Eugene A. Parsons

[57] ABSTRACT

A matrix including a plurality of light emitting devices organized into a plurality of rows of first contacts and columns of second contacts. Row/column decoding switches each coupled to a number of individual rows/columns and to a number of row/column address lines for selecting an addressed one of the number of individual rows/columns, and to an individual row/column data lead for selecting a row/column decoding switch. The matrix and row and column switches are integrated onto a common substrate. A programmable voltage source is coupled to the column decoding switches by the column data leads and a programmable current sink is coupled to the row decoding switches by the row data leads.

20 Claims, 5 Drawing Sheets

12

| $C_N$ | $A_0$ | $\overline{A_0}$ | $A_1$ | $\overline{A_1}$ | COLUMN SELECTED | |
|---|---|---|---|---|---|---|
| 1 | 0 | 1 | 0 | 1 | 0 | 31 |
| 1 | 0 | 1 | 1 | 0 | 1 | 32 |
| 1 | 1 | 0 | 0 | 1 | 2 | 33 |
| 1 | 1 | 0 | 1 | 0 | 3 | 34 |

30

| $R_N$ | $B_0$ | $\overline{B_0}$ | $B_1$ | $\overline{B_1}$ | ROW SELECTED | |
|---|---|---|---|---|---|---|
| 1 | 0 | 1 | 0 | 1 | 0 | 41 |
| 1 | 0 | 1 | 1 | 0 | 1 | 42 |
| 1 | 1 | 0 | 0 | 1 | 2 | 43 |
| 1 | 1 | 0 | 1 | 0 | 3 | 44 |
40 FIG. 4
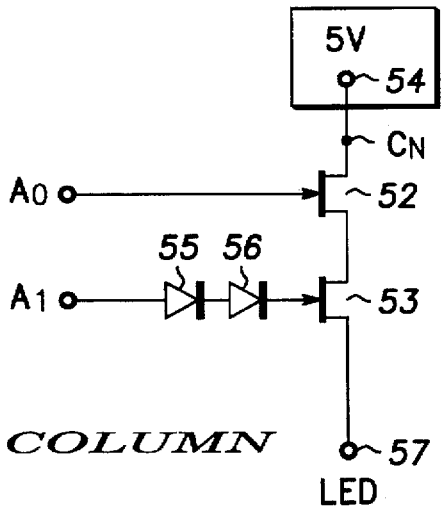
50 FIG. 5
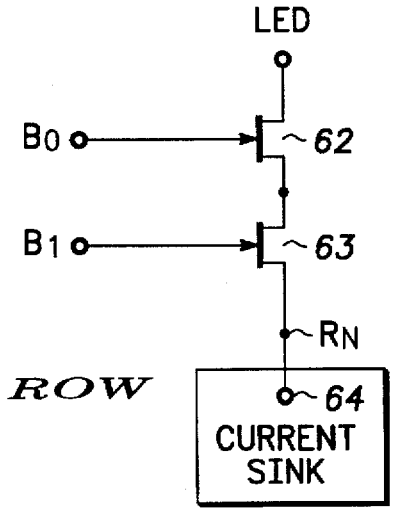
60 FIG. 6

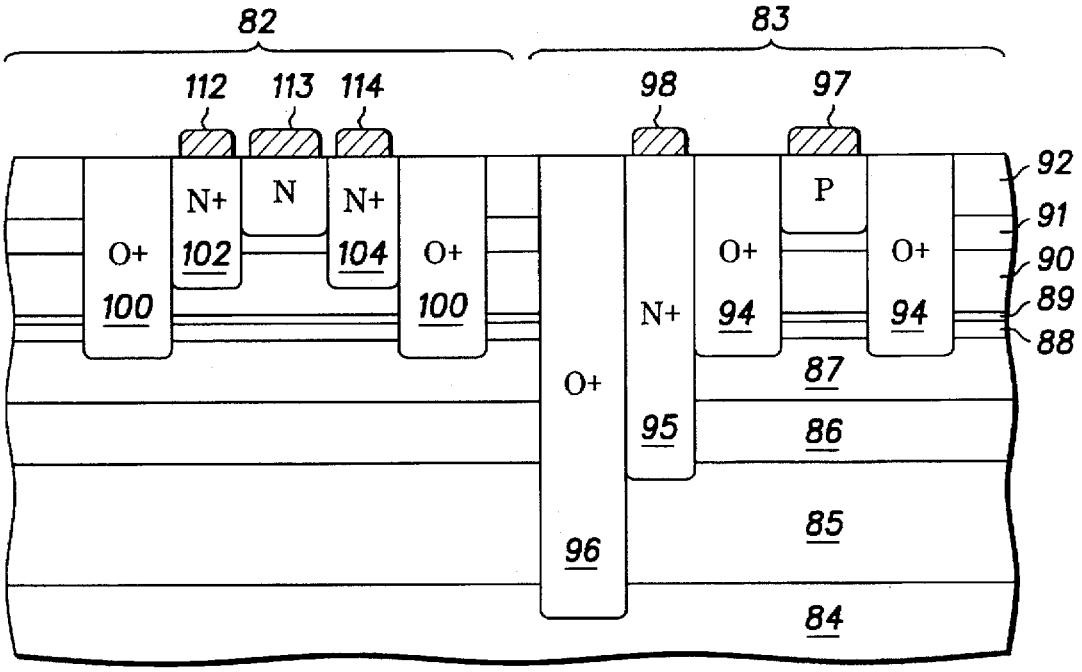
80 FIG. 8
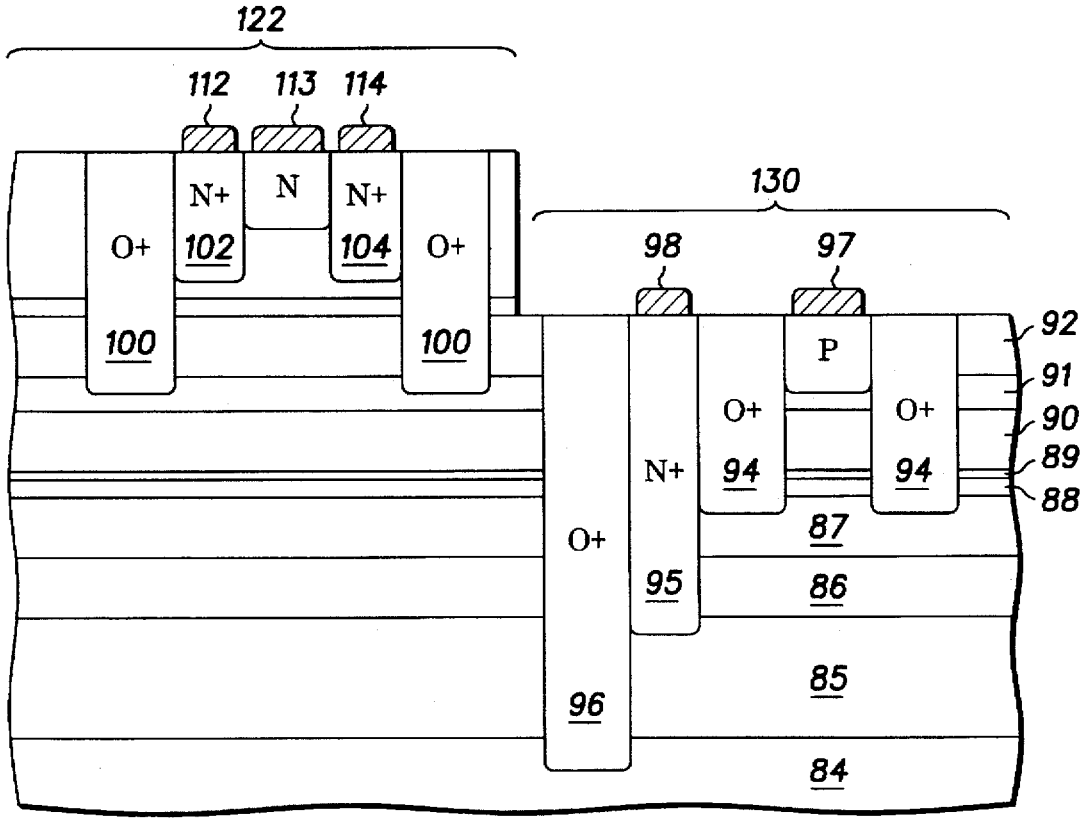
120 FIG. 9

DRIVE DEVICE AND METHOD FOR SCANNING A MONOLITHIC INTEGRATED LED ARRAY

FIELD OF THE INVENTION

The present invention relates, in general, to display devices, and more particularly, to a novel drive device for operating a display.

More particularly, this invention relates to Light Emitting Device (LED) arrays, and more specifically to a monolithic drive device integrated with an LED array.

BACKGROUND OF THE INVENTION

Matrix addressing techniques are well known in the art and have been utilized to control various types of displays such as light emitting diode displays, liquid crystal device (LCD) displays, and field emission device (FED) displays. Matrix addressing schemes typically organize the light emitting elements or pixels into a number of rows and columns with each pixel at an intersection of a particular row and a particular column. Illuminating the pixel requires activating an intersecting row and column thereby providing a closed current path that includes the pixel to be illuminated.

Circuitry for driving an LED matrix display having rows and columns with a plurality of pixels, includes a memory with a certain number of bits width, where the number of bits is equal to the number of pixels, a column output for supplying the number of bits in parallel to a matrix display connected to the column output, and row selection and driver circuitry connected to the memory and to the column output for selecting a complete row of bits of data stored in the memory and supplying the complete row of bits to the column output. Memory for the driver circuitry is for example any of the electronic memories available on the market including but not limited to ROMs, PROMs, EPROMs, EEPROMs, RAMs, etc.

Image information is generally supplied to the LED driver circuitry memory by way of a data input and is stored in a predetermined location by means of an address supplied to the address input. The stored data is supplied to the LED display a complete row at a time by way of a latch/column driver. Each bit of data for each column in the row is accessed in memory and transferred to a latch circuit. The current data is then supplied to the column drivers to drive each pixel in the row simultaneously. At the same time, a shift register is sequentially selecting a new row of data each time a pulse is received from a clock. The newly selected row of pixels is actuated by row drivers so that data supplied to the same pixels by a latch/column driver causes the pixel to emit the required amount of light.

There are two basic approaches for energizing the appropriate row and for transferring data to the appropriate columns. One approach uses decoders while the other approach uses shift registers. Referring to the decoder approach, each row or column is individually addressed. The circuitry required to sequence through the addresses is well understood by those skilled in the art and is not included herein for simplicity.

The shift register takes advantage of the fact that random access to the rows and columns is not generally required in matrix displays, they need only be addressed sequentially. The advantage to the shift register approach is that it only requires a clock pulse to initiate a new row sequence.

It should also be noted that an LED matrix display could be a simple monochrome configuration, a display utilizing monochrome grayscale, or color. For a simple monochrome display, only a one bit digital signal is needed for each pixel, as the pixel is either on or off. For a display utilizing monochrome grayscale, either an analog signal or a multi-bit digital signal is required. A sixteen level grayscale, for example, needs a four bit digital signal. Full color, generally requires at least three light emitting elements per pixel, one for each of the basic colors (red, green and blue), and a type of grayscale signal system to achieve the appropriate amount of each color.

Generally, in non-color type displays (black and white) each pixel contains a single light emitting device which must be driven in a range of values to achieve a range of gray (gray scale) between full on (white) and full off (black). In order to get good gray scale, the data drivers generally have to be able to deliver an accurate analog voltage to each pixel. However, analog driver circuits are very expensive and, since there must be hundreds of data drivers (one for each row of light emitting devices), are the major part of the display cost.

Further, in full color displays, each pixel contains at least three light emitting devices, each of which produces a different color (e.g. red, green, and blue) and each of which must be driven (generally a row at a time) in a range of values to achieve a range of that specific color between full on and full off. Thus, full color displays contain three times as many analog drivers, which at least triples the manufacturing cost of the display. Also, the additional analog drivers require additional space and power, which can be a problem in portable electronic devices, such as pagers, cellular and regular telephones, radios, data banks, etc.

As described above, the columns and rows of the LED matrix require drivers for each individual column or row with additional latching circuits for the column drivers. This configuration is heavily dependent on a large number of I/O terminal counts and the circuit becomes burdensome and not conducive to miniaturization.

Another major concern in adapting displays with large numbers of light emitting elements or pixels to portable applications is the issue of power dissipation. This is a concern for the light emitting elements within the display as well as for the drive electronics. In a typical matrix addressable display, the data is input serially and latched into the circuitry that drives the light emitting elements. Typically a row (or column) is illuminated only a small fraction of the time each time the display is scanned. Because of the high scan rate and the large number of pixels involved, high clock rates are involved in the shifting of data into and out of the memory. The high scan rates and high clock rates required, results in excessive dynamic power dissipation.

Displays utilizing two dimensional arrays, or matrices, of pixels each containing one or more light emitting devices are very popular in the electronic field and especially in portable electronic and communication devices, because large amounts of data and pictures can be transmitted very rapidly and to virtually any location. One problem with these matrices is that each row (or column) of light emitting devices in the matrix must be separately addressed and driven with a video or data driver.

Accordingly, it would be advantageous to be able to manufacture displays, and especially color displays, with simpler and fewer data drivers and with fewer I/O terminals.

It is an object of the present invention to provide new and improved driven matrices of light emitting devices using digital data drivers.

It is another object of the present invention to provide new and improved driven matrices of light emitting devices using fewer data drivers.

It is a further object of the present invention to provide matrix display and driver circuitry which utilizes substantially less power than equivalent prior art displays.

It is still a further object of the present invention to provide improvements in decoding switches of monolithic matrices of LEDs.

It is still a further object of the present invention to provide LED displays which are less expensive, smaller, and easier to manufacture.

It is yet a further object of the present invention to provide LED displays which integrate decoding switches for column and row selection in a monolithic integrated array.

It is still another object of the present invention to provide LED displays with reduced I/O terminal count for column and row selection in LED matrices.

SUMMARY OF THE INVENTION

Briefly, to achieve the desired objects of the instant invention in accordance with a preferred embodiment thereof, provided is a matrix including a plurality of light emitting devices organized into a plurality of rows of first contacts and columns of second contacts. Row/column decoding switches each coupled to a number of individual rows/columns and to a number of row/column address lines for selecting an addressed one of the number of individual rows/columns, and to an individual row/column data lead for selecting a row/column decoding switch.

In a preferred embodiment, the matrix and row and column switches are integrated onto a common substrate. Also, a programmable voltage source is coupled to the column decoding switches by the column data leads and a programmable current sink is coupled to the row decoding switches by the row data leads.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 4 illustrates a truth table for the LED array row decoder switches;

FIG. 5 is a schematic diagram illustrating a single column decoder switch circuit of the plurality of column decode switches illustrated in block form in FIG. 2;

FIG. 6 is a schematic diagram illustrating an LED array row decoder switch circuit;

FIG. 8 is a simplified cross-sectional view illustrating one embodiment of an epi-structure for a column or row decoder switch; and FIG. 9 is a simplified cross-sectional view illustrating another embodiment of an epi-structure for a column or row decoder switch.

DESCRIPTION OF THE PREFERRED EMBODIMENT

Figure 1:
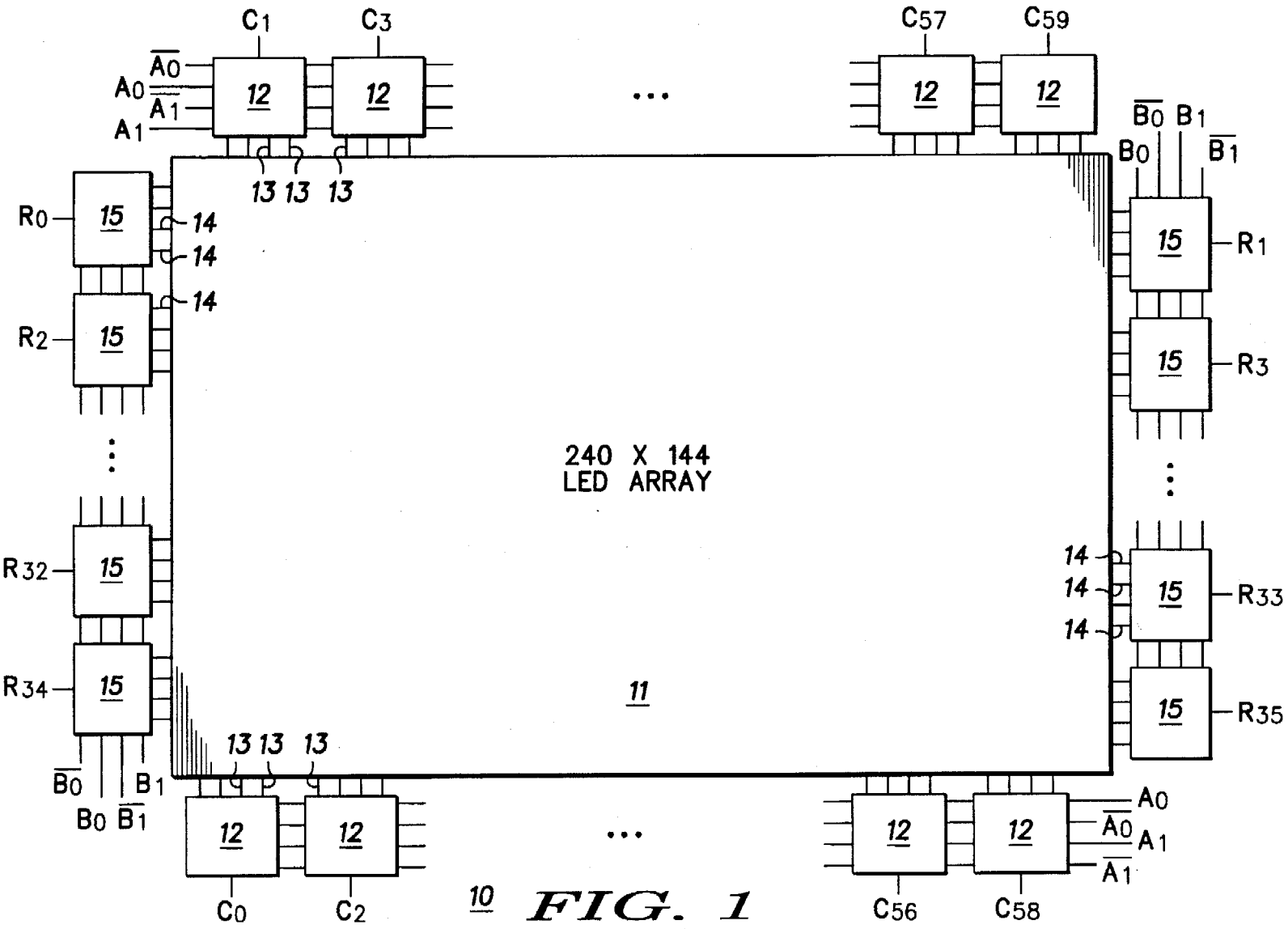
FIG. 1 is a simplified block diagram illustrating a monolithic light emitting device (LED) array with driving circuits in accordance with the present invention.

Turning now to the drawings in which like reference characters indicate corresponding elements throughout the several views, attention is first directed to FIG. 1 which illustrates a light emitting device (LED) array integrated circuit 10. Integrated circuit 10 includes an array 11 of 240 by 144 elements designated pixels, each pixel with a unique column and row electrical connection. It will of course be understood that integrated circuit 10 is being utilized for purposes of this explanation and could in fact include any of a large variety of arrays and specifically, different numbers of columns and rows and/or different types of devices. It will be understood by those skilled in the art that the arrays of light emitting devices may include any of light emitting diodes, liquid crystal devices, field emission devices, etc.

As illustrated in this embodiment of the instant invention, a plurality of column decoder switches 12 comprise 60 column signals, C0 through C59. Input signals C0 through C59 are designated as data signals and two pairs of complimentary input signals, $A_0$, $\overline{A_0}$, $A_1$ and $\overline{A_1}$, are designated as address signals. Each column decoder switch 12 is illustrated as having input signals $A_0$, $\overline{A_0}$, $A_1$, and $\overline{A_1}$, and one of C0 through C59 applied thereto. It will be understood that only two signals and their compliments are used herein because generally a single circuit can generate each signal and its compliment, resulting in further saving of circuitry and chip area. Four individual (i.e. separate and distinct) columns 13 of array 11 are coupled to each column decoder switch 12, thereby the plurality of column decoder switches 12 can address 60 by 4 for a total of 240 columns 13 of array 11. Column decoder switches 12 are proposed for use with an LED array monolithically integrated with the decoding switches to simultaneously reduce the chip I/O count. All of column decoder switches 12 used for column scanning have common address lines $A_0$, $\overline{A_0}$, $A_1$, and $\overline{A_1}$ coupled thereto. As a result, the proposed column decoder switch 12 provides a great reduction in the column related I/O count. The improvements provided by the reduced number of elements for driving the column decoder switches 12 includes, specifically, a reduction in the number of I/O terminals and in the array power dissipation.

The means of addressing columns 13 of array 11 is generally as follows:

Column Selection

Set $C_0$=1 and $C_1$ through $C_{59}$ to zero, thereby selecting columns 0, 2, 4 or 6; and select a specific column 0, 2, 4 or 6 by providing a high signal to different pairs of $A_0$, $\overline{A_0}$, $A_1$, or $\overline{A_1}$(e.g. $A_0$, $A_1$; $A_0$, $\overline{A_1}$; $\overline{A_0}$, $A_1$; or $\overline{A_0}$, $\overline{A_1}$).

Set $C_0$=0, $C_1$=1 and $C_2$ through $C_{59}$ to zero, thereby selecting columns 1, 3, 5, or 7; and select a specific column 1, 3, 5, or 7 by providing a high signal to different pairs of $A_0$, $\overline{A_0}$, $A_1$, or $\overline{A_1}$.

Set $C_0$ and $C_1$ to 0, $C_2$=1 and $C_3$ through $C_{59}$ to zero, thereby selecting columns 8, 10, 12, or 14, etc.

It is now evident that this sequence can be maintained for the selection of four discrete columns 13 by the activation of a data input, $C_0$ through $C_{59}$, and activation of address lines $A_0$, $\overline{A_0}$, $A_1$, and $\overline{A_1}$. Column decoder switches 12 have characteristics which provide a sequential scanning means to also reduce the array power dissipation from the reduced number of chip I/O counts.

Also illustrated in FIG. 1 is a plurality of row decoder switches 15, each with an individual data line of a plurality of input data lines $R_0$ through $R_{35}$ coupled thereto (for a total of 36 row decoder switches 15 in this embodiment). Four individual (i.e. separate and distinct) rows 14 of array 11 are coupled to each row decoder switch 15. Each row decoder switch 15 is activated by the individual data signal $R_0$ through $R_{35}$ coupled thereto and by row address lines $B_0$, $\overline{B_0}$, $B_1$, and $\overline{B_1}$. The means of addressing rows 14 of array 11 is generally as follows:

Row Selection

Set $R_0$=1 and $R_1$ through $R_{35}$ to zero, thereby rows 0, 2, 4, or 6 are selected; and select a specific row 0, 2, 4, or 6 by providing a high signal to different pairs of $B_0$, $\overline{B_0}$, $B_1$, or $\overline{B_0}$ (e.g. $B_0$, $B_1$; $B_0$, $\overline{B_1}$; $\overline{B_0}$, $B_1$; or $\overline{B_0}$, $\overline{B_1}$).

Set $R_0$=0 and $R_1$=1 and $R_2$ through $R_{35}$ to zero, thereby rows 1, 3, 5, or 7 are selected; and select a specific row 1, 3, 5, or 7 by providing a high signal to different pairs of $B_0$, $\overline{B_0}$, $B_1$, or $\overline{B_1}$.

Set $R_0$ and $R_1$=0, $R_2$=1, and $R_3$ through $R_{35}$ to zero, thereby rows 8, 10, 12, or 14 are selected; etc.

A programmable power supply (see FIG. 5) is included in a silicon driver integrated circuit and connected as an input to column decoder switches. Also, a programmable current sink circuit (see FIG. 6) is included in the silicon driver integrated circuit and connected as an output from row decoder switches 15. With the programmable power supply and the programmable current sink the number of devices used for decoder switches 12 and 15 can be minimized. All of column decoder switches 12 have common address lines. As a result, the columns can be scanned sequentially, with no greater than n/4 (where n is the total number of columns) column decoders 12 at once depending on the input power from the programmable power supply. All of row decoder switches 15 have common address lines. As a result, the rows can be scanned sequentially, with no greater than m/4 (where m is the total number of rows) row decoder switches 15 at once depending on the input power from the programmable current sink. Power dissipation is limited by the silicon driver integrated circuit leakage current instead of MESFET leakage current. As a result, the power dissipation is much lower than that obtained from LED array 11 with a conventional decoder. The instant invention thereby reduces the number of I/O terminals required to address LED each pixel of array 11 and greatly reduces the power consumption of LED integrated circuit 10.

By the monolithic integration of low power column decoder switches 12 and row decoder switches 15 with LED array 11 on the same substrate, there is a great reduction in power dissipation. For instance, in a conventional decoder, the power expended for the aforementioned 240 by 144 LED array 11 is 11 watts compared to 36 milliwatts for LED integrated circuit 10 of the instant invention. The added reduction of I/O terminals, from 384 to 104 (in this specific example) illustrates the great improvement over the LED array without the integration of the decoding switches.

Figures 2, 3:
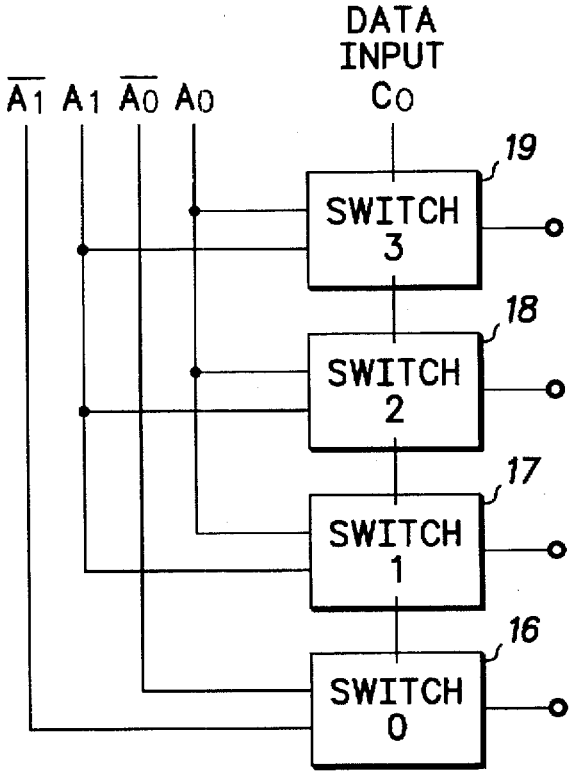
FIG. 2 is a simplified block diagram which illustrating a plurality of LED array column decoder switches.
FIG. 3 illustrates a truth table for the LED array column decoder switches illustrated in FIG. 2.

Turning now to FIG. 2, a single column decoder switch $\mathbf{12}_n$ is illustrated in block form. Column decoder switch $\mathbf{12}_n$ includes a plurality of column decoder circuits 16, 17, 18, and 19 connected to output a signal to one of column 0 through column 3 of LED array 11 in response to appropriate address signals. Associated with this illustration is a truth table 30 illustrated in FIG. 3 which will be referenced as the illustration of FIG. 2 is described. Truth table 30 illustrates the signal levels of each address line, $A_0$, $\overline{A_0}$, $A_1$, and $\overline{A_1}$ designated as a '1' or a '0', with column decoder switch $\mathbf{12}_n$ selected by a high data signal $C_n$ provided by the programmable power supply.

Referring to truth table 30, it should again be noted that $A_0$ and $\overline{A_0}$ are complementary signals and $A_1$ and $\overline{A_1}$ are complementary signals so that when one of the pair is a logic high the other is a logic low level. A first row 31 illustrates the logic signals required for the selection of column circuit 16, note that the input $C_n$ is at a logic high level, $A_0$ and $A_1$ are at a logic low level and $\overline{A_0}$ and $\overline{A_1}$ are at a logic high level. Referring now to a second row 32 in truth table 30, which illustrates the logic signals required for the selection of column circuit 17, the input $C_n$ is still at a logic high level, with $A_0$ and $\overline{A_1}$ being a logic low level and $\overline{A_0}$ and $A_1$ being a logic high level. In a third row 33 in truth table 30, which illustrates the logic signals required for the selection of column circuit 18, the input $C_n$ is still at a logic high level, with $A_0$ and $\overline{A_1}$ being a logic high level and $\overline{A_0}$ and $A_1$ being a logic low level. Finally, in a fourth row 34 in truth table 30, which illustrates the logic signals required for the selection of column circuit 19, the input $C_n$ is still at a logic high level, with $\overline{A_0}$ and $A_1$ being a logic high level and $\overline{A_0}$ and $\overline{A_1}$ being a logic low level. Thus, any column decoder switch 12 is selected by applying a logic high level signal to the associated data input $C_n$ and any of the columns attached to the selected column decoder switch $\mathbf{12}_n$ are selected by utilizing an appropriate combination of address signals $A_0$, $\overline{A_0}$, $A_1$, and $\overline{A_1}$.

FIG. 4 illustrates a selection logic truth table 40 for row decoder switches $\mathbf{15}_n$, which is similar to the column selection of truth table 30. A specific row decoder switch $\mathbf{15}_n$ is selected by supplying a logic high level signal to the associated data input $R_n$. Within the selected row decoder switch $\mathbf{15}_n$, selection of one of four rows is accomplished by means of address lines $B_0$, $\overline{B_0}$, $B_1$, and $\overline{B_1}$, Output $R_0$ is electrically connected to a current sink by means of the programmable current sink and, when connected, designated a 1 in the circuit logic. With address signal input $B_0$ at a high level, which is a designation by a 1 in truth table 40, the variation of inputs from the address lines determines which of the rows 14 attached to row decoder switch $\mathbf{15}_n$ will be activated. As described in conjunction with truth table 30 of FIG. 3, the four rows 41 through 44 of truth table 40 illustrate the logic required for the selection of the four rows of array 10 associated with the particular row decoder switch $\mathbf{15}_n$.

Turning now to FIG. 5, a single column circuit 50 of column decoder switch 12 is illustrated schematically. As will be explained in more detail presently, each column decoder switch 12 includes four column circuits 50. Column circuit 50 includes two field effect transistors (FETs) 52 and 53 connected in series between programmable power supply 54 and a specific column of array 11. In this specific embodiment, programmable power supply 54 is coupled to the input of selected column decoder switches 12 as data signal $C_n$. In this specific column circuit, address line $A_0$ is connected to the gate of FET 52. FET 52 couples a 5 volt potential, provided by means of programmable power supply 54, to second FET 53 when a high logic level is present on address line $A_0$. FET 52 does not couple the 5 volt potential to FET 53 when address signal $A_0$ is a low logic level.

Address line $A_1$ is connected to the gate of FET 53 through two level shifting diodes 55 and 56, which are connected in series with address line $A_1$. Level shifting diodes 55 and 56 provide a voltage shift to the gate of FET 53 to prevent forward biasing the gate-drain diode of FET 53. With MESFET circuits, level shifting diodes 55 and 56 are used to prevent a MESFET gate from being driven into forward bias. As illustrated, field effect transistor 53 conducts when address line $A_1$ is at a high level and couples the 5 volt potential from FET 52 to the associated column of array 11, illustrated as terminal 57. A low logic level on address line A1 prevents FET 28 from conducting.

Referring to FIG. 6, a row circuit 60 is schematically illustrated, four of which make up a complete row decoder switch 15. Row circuit 60 includes two FETs 62 and 63 connected in series between an associated row of array 11 and current sink 64, which is the programmable current sink previously discussed. In this specific embodiment, programmable current sink 64 is coupled to the input of selected row decoder switches 15 as data signal $R_n$. FET 62 couples the associated row of array 11 to FET 63 when address line $B_0$ applies a logic high level signal to the gate. Address line $B_1$ must be at a logic high level to activate FET 63 to complete an electrical circuit to current sink 64. Current sink 64 is electrically coupled to FET 63 as a logic high level signal applied to data line $R_n$ (illustrated as a terminal in FIG. 6). Current sink 64 must be electrically connected to allow current to flow through row circuit 60. Electrical conductivity from the associated row of array 11 to current sink 64 completes an electrical circuit (assuming that at least one column circuit 50 is activated) which activates the specifically addressed LED to emit light.

Figure 7:
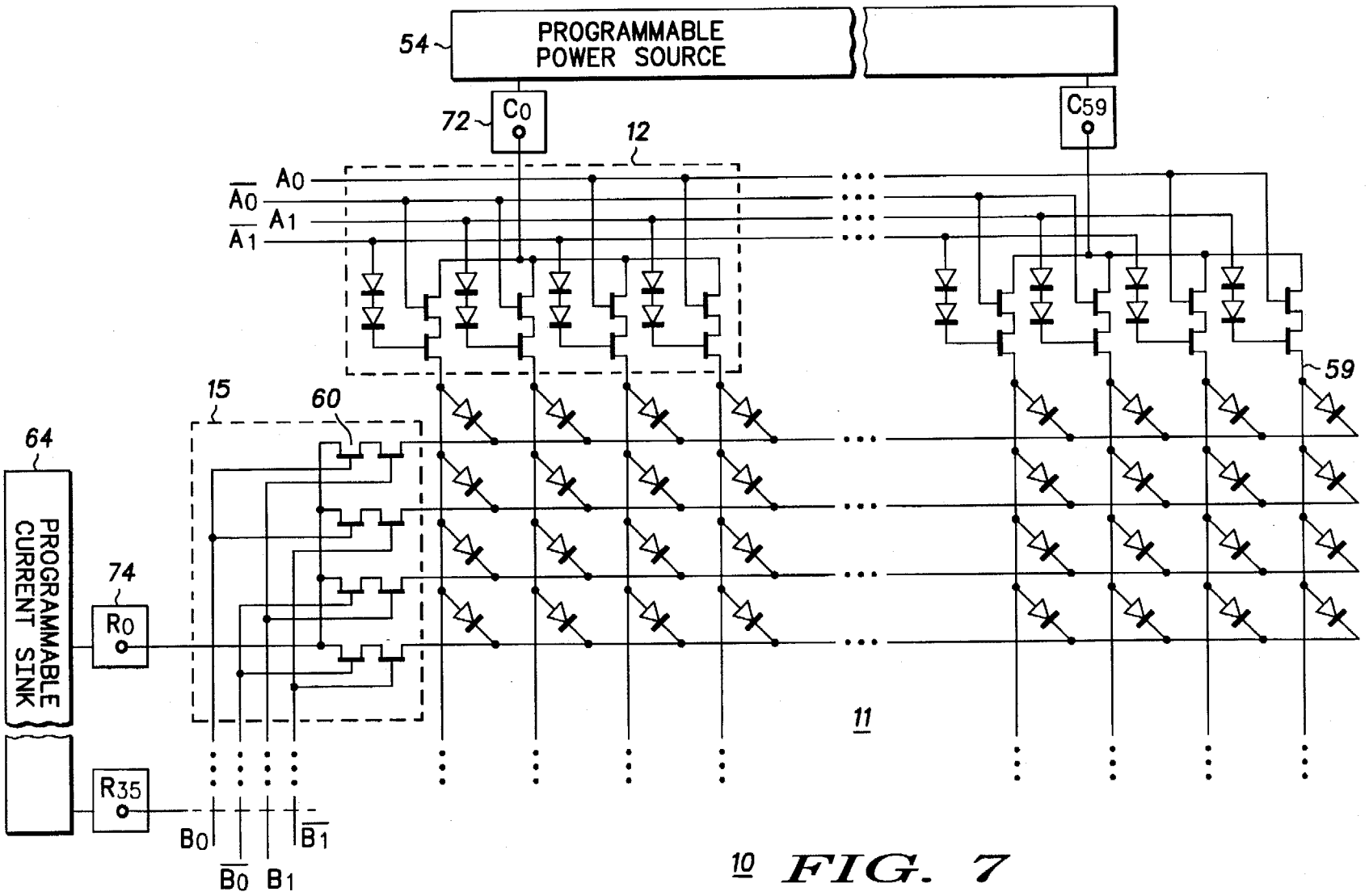
FIG. 7 is a schematic diagram illustrating the monolithic light emitting device (LED) array with driving circuits; of FIG. 1

Referring now to FIG. 7, LED array integrated circuit 10 is illustrated schematically, with portions thereof removed. Integrated circuit 10 includes a plurality of LED's in LED matrix array 11. As an example, one terminal of a specific LED 70 is electrically connected to a first column circuit 50 (illustrated individually in FIG. 5) of a first column decoder switch 12, enclosed in a broken line for convenience of viewing. A second terminal of LED 70 is connected to a first row circuit 60 (illustrated individually in FIG. 6) in row decoder switch 15, enclosed in a broken line for convenience of viewing, as a singular illustration of a plurality of column decoder switches and a plurality of row decoder switches utilized to activate the plurality of columns and rows of LED array 11. This figure illustrates the four LED circuit arrangement of FIG. 2, wherein one column decoder switch 12 activates four columns by connecting programmable power source 54 to the addressed column, with a corresponding row decoder switch 15 completing the circuit by electrically connecting an addressed row from a four row decoder switch 15 to current sink 62. Column circuit 50 is connected to programmable power source 54 on data line $C_0$ by a switch or circuit within programmable power source 54 (illustrated as a block 72), or by otherwise completing a circuit to programmable power source 54. Similarly, row circuit 60 is connected to programmable current sink 64 on data line $R_0$ by a switch or circuit within programmable current sink 64 (illustrated as a block 74), or by otherwise completing a circuit to current sink 64.

It should be understood that programmable power source 54 and programmable current sink 64, in addition to being programmable as to the amount of power supplied at any predetermined time, may also be programmed to sequence automatically through a predetermined program of input signals on data lines $C_0$ through $C_{58}$ and through a predetermined program of input signals on data lines $R_0$ through $R_{35}$.

Illustrated in FIG. 8 is an epi-structure 80 with monolithic integration of a low power decoding switch 82 (illustrated as a single FET) with an LED array 83 (illustrated as a single LED) onto the same substrate. LED array 83 includes a plurality of doped and undoped epitaxial layers formed sequentially on a semi-insulated gallium arsenide substrate 84. As illustrated, the epitaxial layers are an n+-GaAs layer 85, a n-InGap layer 86, an n-AlInP layer 87, an undoped AlGaInP layer 88, an undoped AlInP layer 89, a p-AlInP layer 90, a p-InGaP layer 91 approximately 200 Å thick, and an undoped GaAs layer 92 approximately 500 Å thick to form LED array 83 integrated with corresponding switch 82. Also illustrated are implants 94 provided for pixel isolation, implant 95 provided for electrical connection to the lower terminal of each pixel, and implant 96 provided for row isolation. Metalized connections to each LED in array 83 are provided by contacts 97 and 98. Switch 82 includes device isolation implants metalized contacts 112, 113, and 114 for source, gate and drain terminals, respectively. Additional information on this type of array can be found in U.S. Pat. No. 5,453,386, entitled "Method of Fabrication of Implanted LED Array", issued Sep. 26, 1995, and assigned to the same assignee. Also, for integration techniques, see U.S. Pat. No. 5,483,085, entitled "Electro-Optic Integrated Circuit With Diode Decoder" issued Jan. 9, 1996 and assigned to the same assignee.

A modified epi-structure 120 is illustrated in FIG. 9 which includes a decoding switch 122 integrated with an LED array 130 as a monolithic integration onto the same substrate. LED array 130 is similar to LED array 83 of FIG. 8. Decoding switch 122 is similar to switch 82 of FIG. 8 except that it is fabricated by adding additional epitaxial layers on LED array 130, from LED array 130 to FET 122, during the device fabrication so that p-dopant out diffusion is less of a problem.

Accordingly, methods of manufacturing displays, and especially color displays, with simpler and fewer data drivers and with fewer I/O terminals have been disclosed. Also disclosed are new and improved driven matrices of light emitting devices using digital data drivers and, specifically, matrices of light emitting devices using fewer data drivers. Further, matrix display and driver circuitry is disclosed which utilizes substantially less power than equivalent prior art displays and which are less expensive, smaller, and easier to manufacture. The present invention provides LED displays which integrate decoding switches for column and row selection in a monolithic integrated array with substantially reduced I/O terminal count for column and row selection in LED matrices. It will of course be understood that an LED display can be provided with only one of the assembly of column or row decoding switches and the other of the assembly of row or column (these are of course interchangeable) decoding switches can be replaced with normal hardwired connections, some form of decoding, a shift register, or the like.

With a programmable power supply and a programmable current sink, the number of devices used for a decoding switch can be minimized. Power dissipation is limited by driver leakage current instead of MESFET leakage current. As a result, the power dissipation is much lower than that obtained from an array without programmable power supply or programmable current sink.

All the column decoding switches have common address lines. As a result, the column can be scanned sequentially as n/4 where n is the number of columns at once depending on the input power supply from a driver. All the row decoding switches have common address lines. As a result rows can be scanned sequentially or as m/4 where m is the number of rows at once depending on the status of a programmable current sink. Level shifting diodes used to prevent a MESFET gate from being driven into forward bias are placed in a CMOS driver to supply the decoding switch sequential scanning.

The instant invention reduces the number of I/O terminals to activate LED pixels and greatly reduces the power consumption of the LED integrated circuit. By monolithic integration of a low power decoding switch with an LED array on the same substrate, there is a great reduction in power. For instance, in a conventional decoder, the power expended for a 240 by 144 LED array is 11 watts compared to 36 milliwatts for a decoder switch LED array of the instant invention. The added reduction of I/O terminals, from 384 to 104 is a great improvement over the LED array without the integration of decoding switches.

Various modifications and changes to the embodiments herein chosen for purposes of illustration will readily occur to those skilled in the art. For example, the integrated circuit can be formed in any convenient semiconductor material system or in any convenient organic system. Also, the LED array and switches can be formed in a variety of ways while still performing the stated functions. Further, a variety of different light emitting devices may be utilized and fabricated in a variety of somewhat modified and/or interchanged steps.

The foregoing is given by way of example only. Other modifications and variations may be made by those skilled in the art without departing from the scope of the invention as defined by the following claims.

Having fully described and disclosed the present invention and preferred embodiments thereof in such clear and concise terms as to enable those skilled in the art to understand and practice same, the invention claimed is:

1. A drive device and matrix of light emitting devices comprising:

a matrix including a plurality of light emitting devices with each light emitting device having a first contact and a second contact, the first contacts being organized into a plurality of rows of first contacts and the second contacts being organized into a plurality of columns of second contacts;

a plurality of row decoding switches, each row decoding switch having a current carrying terminal coupled to a number of individual rows of the plurality of rows of first contacts;

a plurality of row address lines, each coupled to each of the plurality of row decoding switches for selecting an addressed one of the number of individual rows coupled to each of the plurality of row decoding switches;

a plurality of row data leads, one each associated row data lead coupled to one each of the row decoding switches for selecting a row decoding switch when an activating signal is supplied to an associated row data lead;

a plurality of column decoding switches, each of the plurality of column decoding switches including a first transistor with current carrying electrodes forming first and second current carrying terminals of the column decoding switch and a control electrode and a second transistor with a first current carrying electrode connected to the second current carrying terminal of the first transistor, a second current carrying terminal, and a control electrode, each column decoding switch having a current carrying terminal coupled to a number of individual columns of the plurality of columns of second contacts;

a plurality of column address lines each coupled to each of the plurality of column decoding switches for selecting an addressed one of the number of individual columns coupled to each of the plurality of column decoding switches; and a plurality of column data leads, one each associated column data lead coupled to one each of the column decoding switches for selecting a column decoding switch when an activating signal is supplied to an associated column data lead.

2. A drive device and matrix of light emitting devices as claimed in claim 1 wherein the plurality of light emitting devices include current driven devices.

3. A drive device and matrix of light emitting devices as claimed in claim 2 wherein the current driven devices include organic light emitting devices.

4. A drive device and matrix of light emitting devices as claimed in claim 1 wherein the plurality of light emitting devices include semiconductor light emitting diodes.

5. A drive device and matrix of light emitting devices as claimed in claim 1 wherein each of the plurality of column decode switches includes a first of the plurality of column address lines coupled to the control electrode of the first transistor and a second of the plurality of column address lines coupled to the control electrode of the second transistor.

6. A drive device and matrix of light emitting devices as claimed in claim 1 including in addition a programmable voltage source coupled to the plurality of column data leads for supplying activating signals to the associated column data leads.

7. A drive device and matrix of light emitting devices as claimed in claim 6 including in addition a programmable current sink coupled to the plurality of row data leads for supplying activating signals to the associated row data leads.

8. A drive device and matrix of light emitting devices as claimed in claim 1 including in addition a programmable voltage source coupled to the plurality of column data leads for supplying power to the selected column decoding switch and to the associated column and a programmable current sink coupled to the plurality of row data leads for supplying a current sink to the selected row decoding switch and to the associated row.

9. A drive device and matrix of light emitting devices as claimed in claim 8 wherein the power dissipation is limited by leakage current of the row and column decoding switches.

10. A drive device and matrix of light emitting devices comprising:

a matrix including a plurality of light emitting devices with each light emitting device having a first contact and a second contact, the first contacts being organized into a plurality of rows of first contacts and the second contacts being organized into a plurality of columns of second contacts;

a plurality of row decoding switches, each of the plurality of row decoding switches including a first transistor with current carrying electrodes forming first and second current carrying terminals of the row decoding switch, and a control electrode and a second transistor with a first current carrying electrode connected to the second current carrying terminal of the first transistor, a second current carrying terminal, and a control electrode, each row decoding switch having a current carrying terminal coupled to a number of individual rows of the plurality of rows of first contacts;

a plurality of row address lines, each coupled to each of the plurality of row decoding switches for selecting an addressed one of the number of individual rows coupled to each of the plurality of row decoding switches;

a plurality of row data leads, one each associated row data lead coupled to one each of the row decoding switches for selecting a row decoding switch when an activating signal is supplied to an associated row data lead;

a plurality of column decoding switches, each column decoding switch having a current carrying terminal coupled to a number of individual columns of the plurality of columns of second contacts;

a plurality of column address lines each coupled to each of the plurality of column decoding switches for selecting an addressed one of the number of individual columns coupled to each of the plurality of column decoding switches; and a plurality of column data leads, one each associated column data lead coupled to one each of the column decoding switches for selecting a column decoding switch when an activating signal is supplied to an associated column data lead.

11. A drive device and matrix of light emitting devices as claimed in claim 10 wherein each of the plurality of row decode switches includes a first of the plurality of row address lines coupled to the control electrode of the first transistor and a second of the plurality of row address lines coupled to the control electrode of the second transistor.

12. A drive device and matrix of light emitting devices comprising:

a substrate;

a matrix positioned on the substrate and including a plurality of light emitting devices with each light emitting device having a first contact and a second contact, the first contacts being organized into a plurality of rows of first contacts and the second contacts being organized into a plurality of columns of second contacts;

a plurality of row decoding switches positioned on the substrate, each row decoding switch having a current carrying terminal coupled to a number of individual rows of the plurality of rows of first contacts;

a plurality of row address lines defined on the substrate and each coupled to each of the plurality of row decoding switches for selecting an addressed one of the number of individual rows coupled to each of the plurality of row decoding switches;

a plurality of row data leads defined on the substrate, one each associated row data lead coupled to one each of the row decoding switches for selecting a row decoding switch when an activating signal is supplied to an associated row data lead;

a plurality of column decoding switches positioned on the substrate, each of the plurality of column decoding switches including a first transistor with current carrying electrodes forming first and second current carrying terminals of the column decoding switch, and a control electrode and a second transistor with a first current carrying electrode connected to the second current carrying terminal of the first transistor, a second current carrying terminal, and a control electrode, each column decoding switch having a current carrying terminal coupled to a number of individual columns of the plurality of columns of second contacts;

a plurality of column address lines defined on the substrate and each coupled to each of the plurality of column decoding switches for selecting an addressed one of the number of individual columns coupled to each of the plurality of column decoding switches; and a plurality of column data leads defined on the substrate, one each associated column data lead coupled to one each of the column decoding switches for selecting a column decoding switch when an activating signal is supplied to an associated column data lead.

13. A drive device and matrix of light emitting devices as claimed in claim 12 including in addition a programmable voltage source coupled to the plurality of column data leads for supplying power to the selected column decoding switch and to the associated column and a programmable current sink coupled to the plurality of row data leads for supplying a current sink to the selected row decoding switch and to the associated row.

14. A drive device and matrix of light emitting devices as claimed in claim 12 wherein each of the plurality of column decode switches includes a first of the plurality of column address lines coupled to the control electrode of the first transistor and a second of the plurality of column address lines coupled to the control electrode of the second transistor.

15. A drive device and matrix of light emitting devices as claimed in claim 12 wherein each of the plurality of row decode switches includes a first transistor with current carrying electrodes forming first and second current carrying terminals of the row decode switch, and a control electrode.

16. A drive device and matrix of light emitting devices as claimed in claim 15, wherein each of the plurality of row decode switches further includes a second transistor with a first current carrying electrode connected to the second current carrying terminal of the first transistor, a second current carrying terminal, and a control electrode.

17. A drive device and matrix of light emitting devices as claimed in claim 16 wherein each of the plurality of row decode switches includes a first of the plurality of row address lines coupled to the control electrode of the first transistor and a second of the plurality of row address lines coupled to the control electrode of the second transistor.

18. A method of addressing a matrix of light emitting devices comprising the steps of:

providing a matrix including a plurality of light emitting devices with each light emitting device having a first contact and a second contact, the first contacts being organized into a plurality of rows of first contacts and the second contacts being organized into a plurality of columns of second contacts;

providing a plurality of row decoding switches, each coupled to one of $R_0$ through $R_n$ leads for selecting the coupled row decoding switch when an activating signal is supplied to one of the $R_0$ through $R_n$ leads, each of the plurality of row decoding switches further being coupled to at least four rows of first contacts (where n is any whole number greater than zero);

providing at least $B_0$, $\overline{B_0}$, $B_1$, and $\overline{B_1}$ row address lines, where $B_0$ and $\overline{B_0}$ are complementary signals and $B_1$ and $\overline{B_1}$ are complementary signals, each coupled to each of the plurality of row decoding switches for selecting an addressed one of the four individual rows coupled to each of the plurality of row decoding switches;

providing a plurality of column decoding switches, each coupled to one of the $C_0$ through $C_m$ leads for selecting the coupled column decoding switch when an activating signal is supplied to one of the $C_0$ through $C_m$ leads, each of the plurality of column decoding switches further being coupled to at least four columns of second contacts (where m is any whole number greater than zero);

providing at least $A_0$, $\overline{A_0}$, $A_1$ and $\overline{A_1}$ column address lines, where $A_0$ and $\overline{A_0}$ are complementary signals and $A_1$ and $\overline{A_1}$ are complementary signals, each coupled to each of the plurality of column decoding switches for selecting an addressed one of the four columns coupled to each of the plurality of column decoding switches; and addressing a specific light emitting device of the matrix by selecting one of $R_0$ through $R_n$ leads and a combination of $B_0$, $\overline{B_0}$, $B_1$, and $\overline{B_1}$ row address lines and selecting one of $C_0$ through $C_n$ leads and a combination of $A_0$, $\overline{A_0}$, $A_1$, and $\overline{A_1}$ column address lines.

19. A method of addressing a matrix of light emitting devices as claimed in claim 18 wherein the steps of providing the matrix, providing the plurality of row decoding switches, providing at least $B_0$, $\overline{B_0}$, $B_1$, and $\overline{B_1}$ row address lines, providing the plurality of column decoding switches, and providing at least $A_0$, $\overline{A_0}$, $A_1$, and $\overline{A_1}$column address lines further includes providing the matrix, switches and lines on a common substrate.

20. A method of addressing a matrix of light emitting devices as claimed in claim 18 including in addition the steps of providing a programmable voltage source, coupling the programmable voltage source to the plurality of column data leads for supplying power to the selected column decoding switch and to the associated column, and providing a programmable current sink and coupling the programmable current sink to the plurality of row data leads for supplying a current sink to the selected row decoding switch and to the associated row.

* * * * *